US007349655B2

(12) United States Patent
Fukuda et al.

(10) Patent No.: US 7,349,655 B2
(45) Date of Patent: Mar. 25, 2008

(54) DEVELOPING DEVICE AND METHOD OF FORMING IMAGES

(75) Inventors: Tadashi Fukuda, Toride (JP); Kota Arimoto, Abiko (JP); Tadayoshi Nishihama, Abiko (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 11/365,225

(22) Filed: Mar. 1, 2006

(65) Prior Publication Data

US 2006/0198662 A1 Sep. 7, 2006

(30) Foreign Application Priority Data

Mar. 7, 2005 (JP) ..... 2005-063178

(51) Int. Cl.
*G03G 15/08* (2006.01)
*G03G 15/01* (2006.01)

(52) U.S. Cl. ..... 399/257; 399/223; 399/258; 399/296

(58) Field of Classification Search ..... 399/257–259, 399/224, 223, 296, 226, 227, 28, 53, 58
See application file for complete search history.

(56) References Cited

U.S. PATENT DOCUMENTS 5,260,753 A 11/1993 Haneda
5,612,777 A * 3/1997 Malhotra ..... 399/226
5,915,144 A * 6/1999 Ide et al.
6,314,253 B1 * 11/2001 Hosoya et al. ..... 399/58
7,245,843 B2 * 7/2007 Bessho
2006/0198661 A1 * 9/2006 Nishihama et al. ..... 399/258

FOREIGN PATENT DOCUMENTS

| | | |
|---|---|---|
| JP | 2-21591 | 1/1990 |
| JP | 4-278967 | 10/1992 |
| JP | 5-6033 | 1/1993 |
| JP | 5-127437 | 5/1993 |
| JP | 2000-147863 | 5/2000 |
| JP | 2003173060 A * | 6/2003 |

* cited by examiner

*Primary Examiner*—Susan Lee
(74) *Attorney, Agent, or Firm*—Canon U.S.A. Inc I.P. Div

(57) ABSTRACT

A developing device configured to carry out development of an electrostatic image using color toner particles and transparent toner particles includes color and transparent developing units configured to store toner particles, carrier particles, and additive particles and configured to carry out development of the electrostatic image; color and transparent developer replenishment containers configured to store replenishment developers including at least the toner particles and the carrier particles and configured to replenish developing units with the replenishment developers; and color and transparent developers openings provided at the developing units and configured to discharge the developers in the developing units outside the developing units while replenishing the developing units with the replenishment developers, wherein the carrier particle weight ratio of the transparent replenishment developer is higher than the carrier particle weight ratio of the color replenishment developer.

8 Claims, 6 Drawing Sheets

DEVELOPING DEVICE AND METHOD OF FORMING IMAGES

BACKGROUND OF THE INVENTION

1. Field of the Invention

The present invention relates to a developing device used for an image forming apparatus, such as a copy machine or a printer, and a method of forming an image and, more specifically, relates to a developing device included in an image forming apparatus using a color toner and a transparent toner according to a two-component development method.

2. Description of the Related Art

For a known image forming apparatus employing electrophotography and, more specifically, for an image forming apparatus configured to form images in chromatic colors, a two-component development method using a developer including a mixture of nonmagnetic toner particles and magnetic carrier particles is widely used.

A two-component development method, compared to other development methods used today, is advantageous in that the image quality is stable and the apparatus is highly durable for long-term use. However, the two-component development method is disadvantageous in that the developer is degraded through use and developability changes due to a reduction in the electrostatic charge (hereinafter referred to as "triboelectricity") caused by degradation of carrier particles and defects in the printout images, such as a change in color as the number of image printouts increase and toner scattering. For these reasons, when the image forming apparatus is to be used long term, down time (time period in which the apparatus cannot be used for printing out images due to adjustment of the apparatus) and man-hours for replacing the developer are required.

Japanese Patent Publication No. 2-21591 discloses a method of reducing the man-hours required for replacing the developer by continuously collecting the degraded developer in small amounts and continuously supplying new developer with the same amounts while maintaining the performance of the developer at a predetermined level. More specifically, by gradually replacing the degraded developer (carrier particles) with new developer, apparent degradation of the carrier particles is prevented, the total volume of the developer is stabilized, and automatic replacement of the developer is substituted for manual replacement.

Recently, in the print-on-demand (POD) market, there has been an increasing need in printing out stable images using electrophotography employing the two-component development method while minimizing down time. To satisfy this need, technology such as that disclosed in Japanese Patent Publication No. 2-21591 is useful. By employing such technology, the degradation of the developer can be stabilized at a predetermined level to prevent a change in image quality due to the degradation of the developer.

Degradation of carrier particles can be defined by a reduction in ability of the carrier particles to apply triboelectric charges to the toner particles. More specifically, the carrier particles gradually degrade, or gradually lose their ability to apply triboelectric charges to the toner particles, when the coating agent covering the surfaces of the carrier particles is scraped off and/or toner particles and additive particles cling to the surface of the carrier particles.

By employing the technology described in Japanese Patent Publication No. 2-21591, degradation of the carrier particles contained in a developing unit can be suppressed. This is possible because, the degradation level of the carrier particles can be changed by changing the frequency of replenishment and drainage of the carrier particles based on the number of printouts made.

More simply, if the carrier particles are replaced frequently, the developer will stay in a relatively fresh state. Now, the difference in the levels of degradation based on image ratio will be described.

The "age" of the carrier particles, i.e., the amount of time each carrier particle is used in a developer container, is represented by printouts, i.e., the number of images printed out on A4-size recording sheets. In a durability test, x represents the number of printouts, P(x) represents the average age of the carrier particles in a developer container, and W(g) represents the total amount of carrier particles in the developer container. Moreover, d(g) represents the amount of new carrier particles that are replenished when toner is consumed to make one printout and also represents the amount of developer that is drained from the developer container as the new carrier particles d(g) are replenished.

For calculation, if it is assumed that image formation and carrier particle replenishment is carried out time-sequentially, the following formula holds:

$$Q(x)=P(x)\times[(W-d)/W]+P(0)\times[d/W] \quad (1)$$

Wherein, P(x) represents the average age of the carrier particles immediately after forming x printouts and immediately before replenishing the carrier particles, and Q(x) represents the average age of the carrier particles immediately after replenishing the carrier particles. Here, since P(0) is the average initial age of the carrier particles, P(0)=0, and, therefore:

$$Q(x)=P(x)\times[(W-d)/W] \quad (2)$$

P(x+1) represents the average age after one printout is made at Q(x). If it is assumed that the carrier particles are used equally in forming the printout, then, the following formula holds:

$$P(x+1)=Q(x)+1 \quad (3)$$

Based on formulas (2) and (3):

$$P(x+1)=P(x)\times[(W-d)/W]+1 \quad (4)$$

$$P(x)=[1-(1-d/W)^x]\times W/d \quad (5)$$

In other words, the average age of the carrier particles when the developer is automatically replaced converges to W/d (total amount of carrier particles in developer container/amount of replaced carrier per printout).

More specifically, for example, if the weight of the developer in the developer container is 375 g and the toner concentration in the developer in the developer container (i.e., proportion of the weight of the toner particles to the total weight of the developer (hereinafter referred to as the "TD ratio")) is 8%, the weight of carrier particles is 345 g. The proportion of the weight of the carrier particles to the total weight of the developer supplied for replenishment (hereinafter referred to as "replenishment developer") is 15% (this proportion is referred to as the "CD ratio"). For example, if 0.7 mg/cm$^2$ is the amount of toner particles that need to be applied to a recording sheet to obtain the maximum density, when the image ratio is 5%, 21.3 mg of toner is consumed per A4-size recording sheet. At this time, the amount of carrier particles replaced per recording sheet is 3.8 mg. The calculation results based on this information are shown in FIG. 3 as a graph illustrating the change in average age.

The dotted line in the graph represents the result when the CD ratio of the replenishment developer is 0%, i.e., when the amount of carrier particles is 0. In this case, the number of printouts made and the average age of the carrier particles are the same. Moreover, FIG. 3 shows the results when the image ratio is 10% and 50%.

As shown in FIG. 3, by using a replenishment developer having a CD ratio of 15%, when 300K (300,000) printouts are made with an image ratio of 5%, the average age of the carrier particles is stabilized at 90K printouts. Whereas, by using a replenishment developer having a CD ratio of 0%, when 300K printouts are made with an image ratio of 5%, the average age of the carrier particles is 300K printouts wherein replacement of the developer is required.

In this way, by draining the carrier particles from the developer container and replenishing new carrier particles together with new toner particles, the degradation level of the carrier particles in the developer container can be suppressed.

In response to the recent increase in need for high-quality images, technology for improving image quality has been proposed. Such technology includes an inkjet image forming apparatus configured to printout photographic-quality images using five or more ink colors. Furthermore, for an image forming apparatus employing electrophotography, technology for achieving high image quality by improving the half tone gradation by using multi-color development (development of five or more colors) and improving the glossiness of the surface of the recording sheet by fixing a transparent toner on the uppermost layer of the sheet has been proposed.

For example, Japanese Patent Laid-Open No. 4-278967 (corresponding to U.S. Pat. No. 5,260,753) discloses technology for improving the glossiness of the image surface by developing the entire image formation area with a transparent toner so as to provide a color image having a color tone similar to a silver photograph.

Japanese Patent Laid-Open Nos. 5-6033, 5-127437, and 2000-147863 disclose technologies for, not only improving the glossiness of the image surface by developing the entire image formation area with a transparent toner, but also providing an image even more similar to a silver photograph by adjusting the amount of transparent toner applied to the surface of the recording sheet so as to form a uniform surface with less unevenness caused by accumulation of the toner.

However, when using both a color toner and a transparent toner in a two-component development method, the following problems have been discovered.

Any development method using the above-described transparent toner applies transparent toner to the entire image to develop a substantially solid image. Therefore, each time an image is printed out, the transparent toner consumed in forming the solid image must be replenished.

Therefore, for example, when multiple printouts are made, a large quantity of toner is repeatedly replenished, causing development to be carried out with toner that has been insufficiently charged. If the toner is insufficiently charged, the triboelectric charge is lowered, causing problems, such as toner scattering inside the apparatus and fogging. Such problems may be solved by extending the stirring path of the developer inside the developing unit, i.e., the length from the developer inlet to the outlet where the developer is supplied for development or by increasing the volume of the developer in the developing unit so that the toner supplied to the developing unit is sufficiently charged before the toner reaches the developer bearing member configured to deliver the toner to the opposing area (development area) of the image bearing member. However, such method causes an increase in costs since the size of the developing unit is increased and the structure of the developing unit becomes complicated. Furthermore, there is another problem in that when the image ratio is high and the toner in the developing unit is replaced frequently, accumulation of additive particles (attachment of the additive particles to the surface of the carrier particles and/or the additive particles being released) accelerates the degradation of the carrier particles and may cause significant reduction in the triboelectric charge of the toner and developability. A change in developability may cause defective images with color change and/or toner scattering.

In other words, such as the transparent toner developing unit, when images having a high image ratio are printed out repeatedly, the large amount of toner consumed as compared to when images having a low image ratio are printed out, the number of toner replenishment increases. Therefore, the amount of carrier particles replenished to the developing unit also increases. When the image ratio is high, accumulation of the additive particles (attachment of the additive particles to the surface of the carrier particles and/or the additive particles being released) becomes significant.

Furthermore, FIG. 4 shows a graph of calculated results and experimental results of the average age of the carrier particles when a replenishment developer having a CD ratio of 10% is used and the image ratios of the printouts are 10% and 30%. When the image ratio is either 10% or 30%, a correlation between the calculated result and the experimental result is recognized.

In contrast, FIG. 5 shows the calculated result and the experimental result of the average age of the carrier particles when a substantially solid image is developed using a replenishment developer having a CD ratio of 10% at an image ratio of 70% in accordance with the example of transparent toner usage. In this case, the calculated result and the experimental result do not match at all.

Here, the actual average age of the carrier particles (experimental result) is determined by measuring the ability of charging the toner when the carrier particles and the toner particles tested for durability are mixed under predetermined conditions and by comparing this with the charging ability of the initial carrier particles and the replaced carrier particles. Furthermore, the average age of the carrier particles can be determined by comparing the surfaces of the aged carrier particles with initial carrier particles for the amount of additive particles attached to the surfaces and/or scratches and unevenness of the surfaces.

When the inside of the apparatus used for the experiment was checked after conducting the durability test with an image ratio of 70%, intensive scattering of the transparent toner was observed inside the apparatus. During the durability test, after about 150K printouts, a decrease in the triboelectric charge of the toner due to degradation of the developer was observed at the transparent toner developing unit. This decrease caused excess amounts of transparent toner to be applied to the recording sheet and defective fixing and jamming of the recording sheets due to defective conveying to occur.

When the property of the developer in the transparent toner developing unit was checked after the durability test conducted at an image ratio of 70% was completed, the triboelectric charge of the initial toner was 37 μC/g, whereas the triboelectric charge of the toner after completion of the durability test was 18 μC/g, which is about half of that of the initial toner. Moreover, the amount of additive particles in the developing unit had significantly increased, and the additive particles had attached to the surface of the carrier particles and/or had been released.

In other words, when printouts with a high image ratio are repeatedly outputted, the amount of carrier particles replenished to the developing unit increases as the number of toner replenishment increases. As a result, the average age of the carrier particles in the developing unit is lowered. However, when the image ratio is increased to about 70%, the effect of the degradation of the carrier particles due to accumulation of the additive particles (attachment of the additive particles to the surface of the carrier particles and/or the additive particles being released) surpasses the effect of the renewal of the carrier particles by replacement.

In other words, when the image ratio is low, the following relationship holds:

renewal of carrier particles by replacement>degradation due to accumulation of additive particles.

As shown in FIG. 4, there is a correlation between the calculated results and the experimental results of the average age of the carrier particles.

However, when the image ratio is high, such as in the above-described case where transparent toner is used, the following relationship holds:

degradation due to accumulation of additive particles>renewal of carrier particles by replacement Wherein, the actual developer degrades significantly faster than the theoretical estimate. As a result, as shown in FIG. 5, the calculated result and the experimental result of the average age of the carrier particles do not match at all.

Therefore, when the image ratio is high, the replenished toner is insufficiently charged because the developer is degraded even though the carrier particles are being replaced. As a result, toner scattering, fogging, and/or defective fixing due to excess application of the toner onto the recording sheet may occur.

Moreover, the increase in the toner causing fogging may increase the load applied on the cleaning member, causing defective cleaning. Moreover, in case an optical sensor is used to read the amount of light reflected from the photosensitive body or the intermediate transfer body, fogging may cause a change in the detected amount of reflected light, causing erroneous detection and/or erroneous operation of the sensor.

To avoid such above-described problems, down time and man-hours for replacing the developer are required when the image forming apparatus is used long term.

SUMMARY OF THE INVENTION

The present invention is directed to an image forming apparatus and a method of forming image using color toner particles and transparent toner particles and having a configuration in which a developer including toner particles and carrier particles is replenished while the developer in a developing unit is drained/discharged.

According to one aspect of the present invention, an image forming apparatus, configured to carry out development of an electrostatic image using color toner particles and transparent toner particles, includes a color developing unit configured to store a color developer which contains the color toner particles, first carrier particles, and first additive particles and configured to carry out development of the electrostatic image; a transparent developing unit configured to store a transparent developer which contains the transparent toner particles, second carrier particles, and second additive particles and configured to carry out development of the electrostatic image; a color developer replenishment container configured to store a color replenishment developer including at least the color toner particles and the first carrier particles and configured to replenish the color developing unit with the color replenishment developer; a transparent developer replenishment container configured to store a transparent replenishment developer including at least the transparent toner particles and the second carrier particles and configured to replenish the transparent developing unit with the transparent replenishment developer; a color developer discharge opening provided at the color developing unit and configured to discharge the color developer in the color developing unit outside the color developing unit as the color developer replenishment container replenishes the color developing unit with the color replenishment developer; and a transparent developer discharge opening provided at the transparent developing unit and configured to discharge the transparent developer in the transparent developing unit outside the transparent developing unit as the transparent developer replenishment container replenishes the transparent developing unit with the transparent replenishment developer, wherein a carrier particle weight ratio of the transparent replenishment developer is higher than a carrier particle weight ratio of the color replenishment developer.

According to another aspect of the present invention, a method of forming an image by carrying out development of an electrostatic image using color toner particles and transparent toner particles includes the steps of developing the electrostatic image by a color developing unit with a color developer which contains the color toner particles, first carrier particles, and first additive particles; developing the electrostatic image by a transparent developing unit with a transparent developer which contains the transparent toner particles, second carrier particles, and additive particles; replenishing the color developing unit with a color replenishment developer including at least the color toner particles and the first carrier particles, the color replenishment developer being supplied from a color developer replenishment container; replenishing the transparent developing unit with a transparent replenishment developer including at least the transparent toner particles and the second carrier particles, the transparent replenishment developer being supplied from a transparent developer replenishment container; discharging the color developer in the color developing unit outside the color developing unit via a color developer discharging opening provided at the color developing unit responsive to replenishing the color developing unit with the color replenishment developer; and discharging the transparent developer in the transparent developing unit outside the transparent developing unit via a transparent developer discharging opening provided at the transparent developing unit responsive to replenishing the transparent developing unit with the transparent replenishment developer, wherein a carrier particle weight ratio of the transparent replenishment developer is higher than a carrier particle weight ratio of the color replenishment developer.

Further features of the present invention will become apparent from the following description of exemplary embodiments (with reference to the attached drawings).

DESCRIPTION OF THE EMBODIMENTS

A development device and an image forming apparatus according to embodiments of the present invention will be described in detail below with reference to the drawings.

First Embodiment

[Overall Structure and Operation of Image Forming Apparatus]

Figure 1:
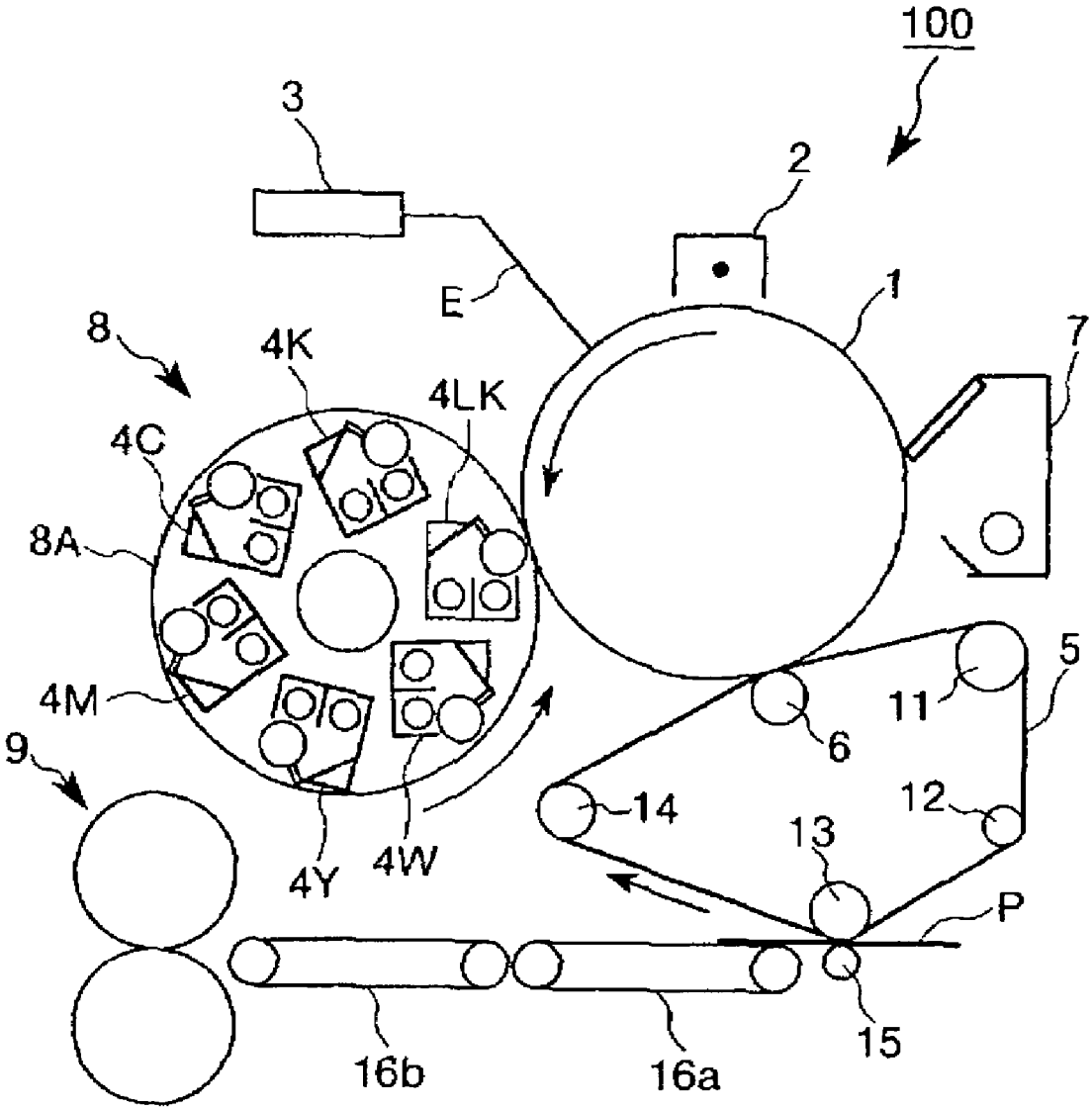
FIG. 1 is a schematic view illustrating an image forming apparatus according to an embodiment of the present invention.

First, the overall structure and the operation of an image forming apparatus will be described. FIG. 1 is a schematic view illustrating an image forming apparatus 100 according to this embodiment. The image forming apparatus 100 can be, for example, a full color laser beam printer capable of forming a full color electrophotographic image on a recording material, such as a sheet of recording paper, an overhead projector (OHP) sheet, or fabric, in accordance with an image information signal sent from an external apparatus, such as a personal computer, connected to and communicating with the image forming apparatus body.

The image forming apparatus 100 includes a photosensitive drum 1 that is a drum-shaped electrophotographic photosensitive body, which is an image bearing member. Around the photosensitive drum 1, a charging device 2, a laser exposure device 3, a cleaner 7, and a rotary developing device 8 are disposed. Opposite to the photosensitive drum 1, an intermediate transfer belt 5, which is an intermediate transfer body, is supported by rollers 11, 12, 13, and 14.

The rotary developing device 8 includes a rotary body 8A (hereinafter referred to as a "developing rotary 8A") disposed opposite to the photosensitive drum 1 and rotatably supported. The developing rotary 8A includes five color toner developing units, i.e., a yellow toner developing unit 4Y, a magenta toner developing unit 4M, a cyan toner developing unit 4C, a black toner developing unit 4K, a light black toner developing unit 4LK, and a transparent toner developing unit 4W.

For example, when forming a full color image, first, the surface of the photosensitive drum 1 is charged by the charging device 2. Then, the charged surface of the photosensitive drum 1 is irradiated with a beam of an optical image E from the laser exposure device 3, and, as a result, an electrostatic image (electrostatic image) is formed on the photosensitive drum 1. The electrostatic image is developed by the rotary developing device 8. More specifically, the developing rotary 8A is rotated in the direction indicated by the arrow so that a predetermined developing unit, e.g., the light black toner developing unit 4LK, is moved to a development area opposing the surface of the photosensitive drum 1. By operating the light black toner developing unit 4LK, a developer image, i.e., a toner image, is formed on the photosensitive drum 1.

The toner image formed on the photosensitive drum 1 is transferred onto the intermediate transfer belt 5 at the area where the intermediate transfer belt 5 opposes the photosensitive drum 1 by the effect of a primary transfer bias applied by a primary transfer roller 6.

By repeating the above-described operation, yellow, magenta, cyan, black, light black, and transparent toners are overlapped in order so as to form a multiple toner image. According to this embodiment, to improve the glossiness and smoothness of the image, in the entire image formation area, a small amount of the transparent toner is applied to the area where a large amount of color toners is applied, and a large amount of the transparent toner is applied to the area where a small amount of color toners is applied so that the entire multiple toner image is substantially flush. Alternatively, the transparent toner can be applied evenly on the entire image formation area, and then the color toners and the transparent toner can be used to form a toner image that is flush. The method of forming an image using a transparent toner is not limited, and any suitable method may be selected.

The multiple toner image formed on the intermediate transfer belt 5 is transferred onto a recording sheet P at an area (secondary transfer section) opposing a secondary transfer roller 15 and the intermediate transfer belt 5 by the effect of a secondary bias applied to the secondary transfer roller 15. The recording sheet P is conveyed from a recording sheet supplying unit (not shown in the drawings) to the secondary transfer section when the tip of the multiple toner image on the intermediate transfer belt 5 reaches the secondary transfer section.

The recording sheet P on which the toner image is transferred is conveyed by conveying belts 16*a* and 16*b* to a roller transfer unit 9. The recording sheet P is pressurized and heated by the roller transfer unit 9 so that the toner image is fixed onto the recording sheet P as a permanent image. Then, the recording sheet P is ejected outside the apparatus.

Residual toner from the primary transfer remaining on the photosensitive drum 1 after carrying out the primary transfer is removed by the cleaner 7. Furthermore, residual toner from the secondary transfer remaining on the intermediate transfer belt 5 after carrying out the secondary transfer is removed by a transfer belt cleaner not shown in the drawings.

[Developing Unit]

Next, a development unit 4 (4Y, 4M, 4C, 4K, 4LK, or 4W) will be described in detail with reference to FIG. 2. According to this embodiment, the development units 4Y, 4M, 4C, 4K, 4LK, and 4W have substantially the same structure except that the color of the toner used for each unit differs.

The development unit 4 includes a developer container 41 that contains a two-component developer (developer) T including a nonmagnetic toner (toner) and a magnetic carrier (carrier). The developer container 41 includes an opening 41*a* opposing the photosensitive drum 1. A development sleeve 42, which is a developer bearing body, is rotatably disposed at the opening 41*a* so that part of the development sleeve 42 is exposed. The development sleeve 42 is composed of a nonmagnetic material. A fixed magnet 43, which generates a magnetic field, is disposed inside the development sleeve 42. Inside the developer container 41, stirring screws 45 and 46 are provided. The toner T in the developer container 41 is stirred by the stirring screws 45 and 46 and is circulated.

Figure 2:
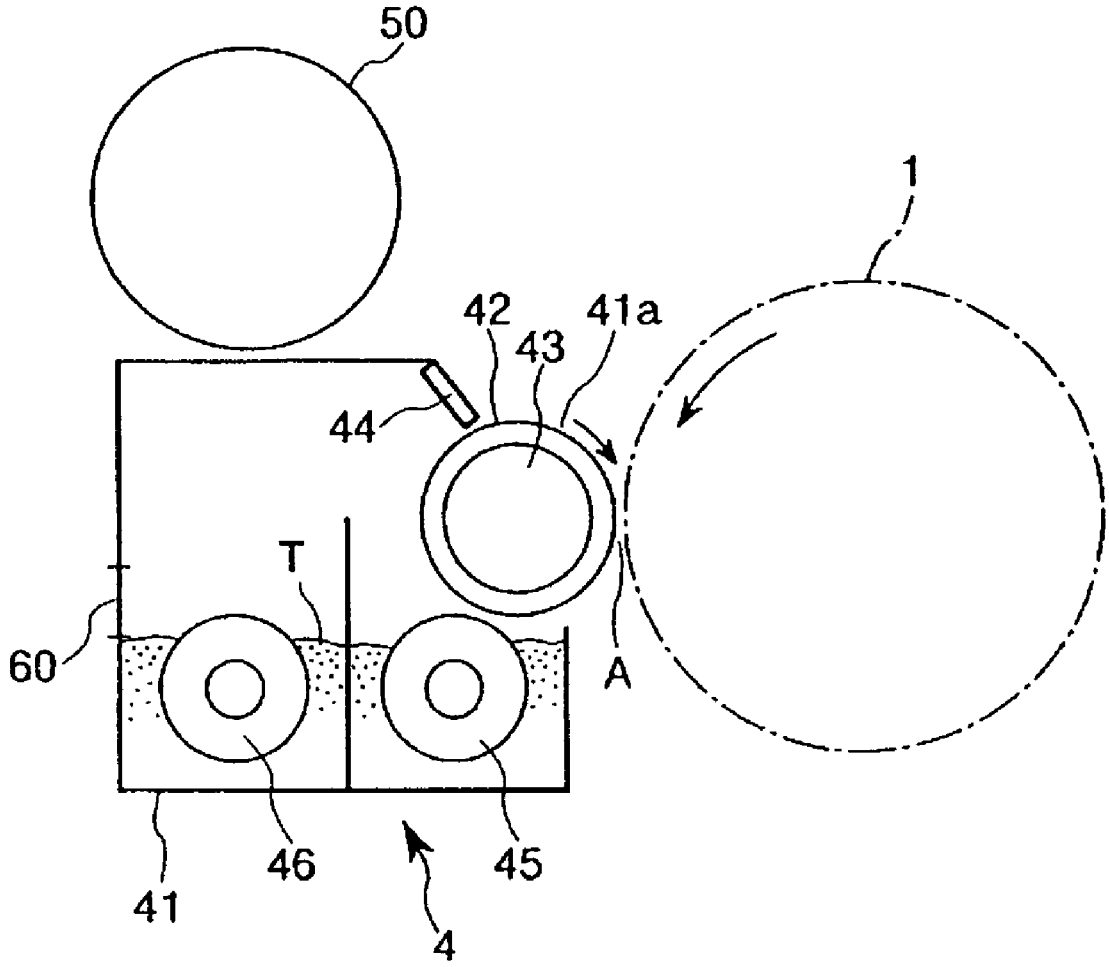
FIG. 2 is a schematic view of a development unit included in the image forming apparatus illustrated in FIG. 1.
Figure 3:
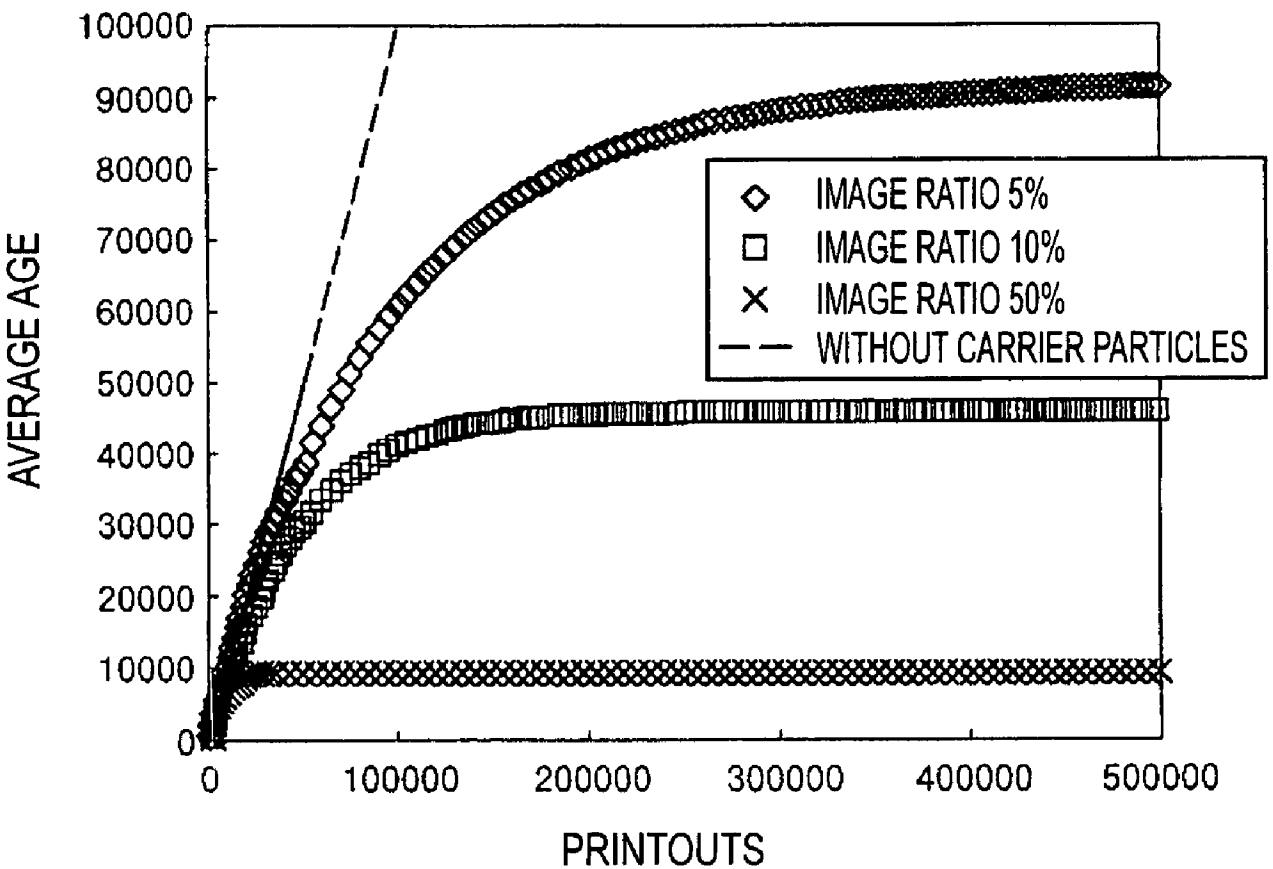
FIG. 3 is a graph illustrating the average age of a carrier.
Figure 4:
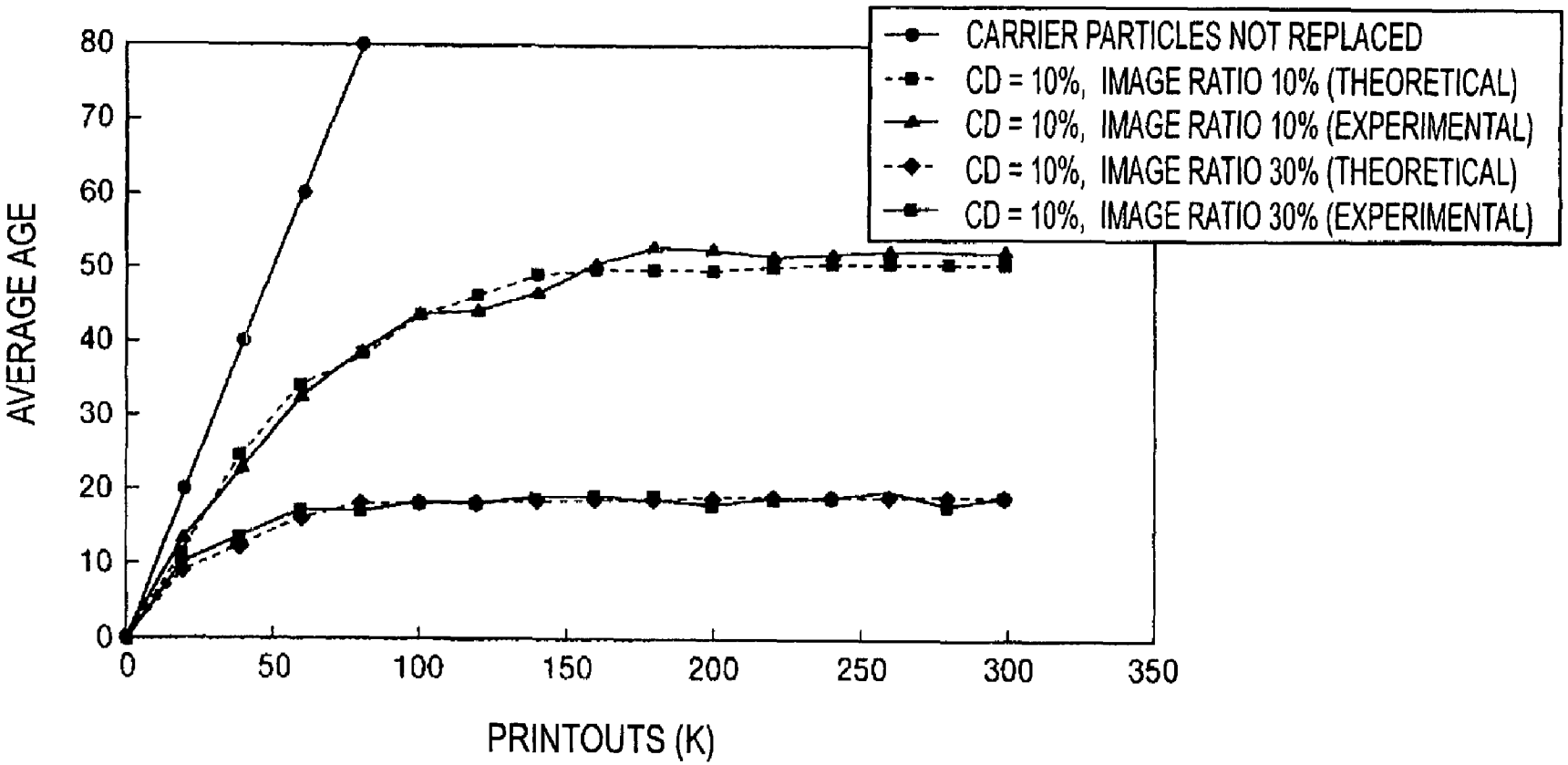
FIG. 4 is a graph illustrating the calculated results and the experimental results of the average age of a carrier for a low image ratio.

When carrying out development, the development sleeve 42 rotates in the direction indicated by the arrow in FIG. 2 so as to bear the toner T in the developer container 41. As the development sleeve 42 rotates, a blade, which is a developer limiting member, limits the amount of toner T to form a film of toner T. Then, the film of toner T is conveyed to a development region A opposing the photosensitive drum 1. In the development region A, the toner included in the toner T is supplied onto the photosensitive drum 1 in accordance with the electrostatic image. In this way, the electrostatic image formed on the photosensitive drum 1 is developed into a toner image. After the electrostatic image is developed, the toner T is conveyed as the development sleeve 42 rotates and is collected in the developer container 41.

A development bias obtained by superimposing an alternating voltage to a direct voltage is applied from a development bias generation unit (not shown in the drawing) to the development sleeve 42. According to this embodiment, the waveform of the alternating component of the development bias is rectangular and, for example, has a frequency of 2 kHz and a peak-point voltage ($V_{pp}$) of 2 kV. The development bias forms an alternating electric field between the development sleeve 42 and the photosensitive drum 1 and electrically separates the toner particles from the carrier particles to form toner mist. In this way, the development efficiency is improved.

More specifically, the color toner included in the developer is made by kneading a resin binder, mainly composed of polyester, with a colorant, grinding the kneaded product, and sorting out particles having an average grain size of about 8 μm. According to this embodiment, the light black toner, which is a light color toner, is made in the same way as the black toner, which is a dark color toner, except that the amount of colorant included is smaller.

The transparent toner is made of resin, not including a colorant, with an average grain size of about 1 to 25 μm and has high optical transparency. The transparent toner is made of styrene acrylic copolymer resin, for example, obtained by copolymerizing a styrene based monomer, such as styrene, monomer of acrylic esters, such as butyl acrylate, and/or monomer of methacrylic esters, such as methyl methacrylate, or, instead, may be a thermoplastic resin, such as polyester resin or other thermosetting resins. The transparent toner is substantially colorless and transmits at least visible light without substantially dispersing the light.

If necessary, other predetermined components may be added to the transparent toner. For example, if waxes, fatty acids, or metal salt of fatty acid is added, a uniform film is easily formed when the transparent toner melts during fixing. In this way, the transparency is improved and a color printout image having excellent surface glossiness can be obtained. This also is effective in that offset is prevented when fixing by a heat roller is carried out. In addition, silica, alumina, titania (titanic oxide), or organic resin particles may be added as additive particles so as to maintain the fluidity and charge application ability of the toner. An amount of additive particles to be added in weight ratio with respect to the toner can be about 0.02% or more to 7.0% or less. According to this embodiment, the developer container 41 contains a developer that at least includes toner particles, carrier particles, and additive particles.

Each carrier particle has a core, mainly composed of ferrite, that is coated with silicon resin. The carrier particles have a 50% particle diameter (D50) of about 40 μm.

Such toner particles and carrier particles are mixed at a weight ratio of about 8 to 92 so that a two-component developer having a toner concentration (TD ratio) of 8% is obtained.

[Developer Replenishment Mechanism]

The main structure of this embodiment will be described below.

According to this embodiment, the developing device 8 includes a developer replenishment mechanism configured to replenish the developer container 41 of each development unit 4 with a replenishment developer including at least toner particles and carrier particles. The rotary developing device 8 also includes a developer drainage mechanism configured to drain the developer from the developer container 41 of each development unit 4.

In other words, when the toner particles are consumed by image formation, the same amount of toner particles is supplied from a replenishment developer tank 50. According to this embodiment, a replenishment developer supplied from the replenishment developer tank 50 is a mixture of toner particles and carrier particles and is supplied to compensate for the toner particles consumed by image formation. At this time, the developer container 41 is replenished with new carrier particles. More specifically, the developer replenishment mechanism is provided for each development unit 4 and includes the replenishment developer tank 50 and a replenishment unit (not shown in the drawings) configured to deliver the replenishment developer from the replenishment developer tank 50 to an inlet (not shown in the drawings) provided at the developer container 41 and to supply the replenishment developer from the inlet to the developer container 41. The replenishment unit according to this embodiment is a rotatable screw that is driven in accordance with the predetermined amount of replenishment developer supplied for image formation so that the developer container 41 is replenished with the predetermined amount of replenishment developer. In this way, the developer replenishment mechanism supplies at least toner particles and carrier particles in a predetermined weight ratio to each development unit 4. The replenishment developer may include predetermined proportions of the same additive particles added to the developer in the development unit. This proportion, for example, is the same as the weight ratio of the toner particles to the additive particles in the developer in the development unit.

The amount of replenishment developer to be supplied may be determined by any method known to one skilled in the art. For example, any one of an inductance detection automatic toner replenishment device (ATR), an optical detection ATR, a patch detection ATR, and a video count ATR, or a combination of any two may be used. In the inductance detection ATR, an inductance sensor configured to detect the magnetic permeability of the developer directly detects the concentration of toner particles in the developer in the developer container 41. In the optic detection ATR, for example, a reflective optical sensor directly detects the concentration of toner particles in the developer in the developer container 41. In this way, the amount of replenishment developer to be supplied is determined on the basis of the detected toner particle concentration. In the patch detection ATR, a reference toner image (patch image) is provided in advance on the photosensitive body (intermediate transfer body or recording sheet bearing member), and its image density is detected with, for example, a reflective optical sensor so as to indirectly detect the concentration of toner particles in the developer in the developer container 41. The video count ATR calculates the amount of toner used based on an integrated value of the concentration of each pixel in the formed image so as to estimate the toner particle concentration in the developer in the developer container 41. Then, the amount of replenishment developer to be supplied is determined on the basis of the estimated toner particle concentration. According to the present invention, the method of controlling the replenishment of the developer is not limited, and any suitable method may be applied.

By replenishing the developer container 41 with new carrier particles, the amount of developer in the developer container 41 is increased. An amount substantially equal to the increased amount of developer is drained from a developer drain 60 provided on a wall of the developer container 41. The position of the developer drain 60 is adjusted so that the developer in the developer container 41 is stabilized at about 375 g. The drained developer is collected with a collecting screw (not shown in the drawings) provided at the center of the developing rotary 8A and then collected in a waste developer container (not shown in the drawings). More specifically, according to this embodiment, the developer drainage mechanism includes the developer drain 60 and a waste developer delivery unit (not shown in the drawings) configured to deliver the developer drained from the developer drain 60 to the waste developer container.

Hereinafter, each replenishment developer tank 50 containing yellow, magenta, cyan, black, or light black tank is referred to as a "color toner replenishment tank," and the replenishment developer tank 50 containing transparent toner is referred to as a "transparent toner replenishment tank."

According to this embodiment, the CD ratio (the ratio of weight of carrier particles to the total weight of the developer), which is the weight ratio of the carrier particles to the replenishment developer contained in the replenishment developer tank 50, of the developer in the color toner replenishment tank differs from the CD ratio of the developer in the transparent toner replenishment tank. In other words, the CD ratio of the transparent replenishment developer in the transparent toner replenishment tank is higher than the CD ratio of the color replenishment developer in the color toner replenishment tank.

More specifically, the CD ratio of the transparent replenishment developer in the transparent toner replenishment tank is about 20%, whereas the CD ratio of the color replenishment developer in the color toner replenishment tank is about 10%. Since the total initial weight of the replenishment developer in each replenishment developer tank 50 is about 400 g, the weights of the toner particles and carrier particles contained in the transparent toner replenishment tank are about 320 g and 80 g, respectively. In other words, according to this embodiment, the weight of the transparent toner supplied to the transparent toner replenishment tank differs from the weight of the color toner supplied to the color toner replenishment tank. The weight of the transparent toner supplied to the transparent toner replenishment tank is smaller than the weight of the color toner supplied to the color toner replenishment tank.

Since the average image ratio changes depending on the operator and the environment of the image forming apparatus 100, it is possible to set the CD ratio of the replenishment developer in the transparent toner replenishment tank higher than that of the color toner replenishment tank. Here, "average image ratio" is determined by calculating the proportion (ratio) of the area occupied by an image (electrostatic image) formed in an image formation region for a plurality of images and averaging these values.

The results of study are described below.

When an image is formed using a transparent toner under normal condition so that the glossiness and the smoothness of the image is improved, the average image ratio of an image formed with the transparent toner is about 70% and the average image ratio of an image formed with the color toner is about 30%.

Figure 5:
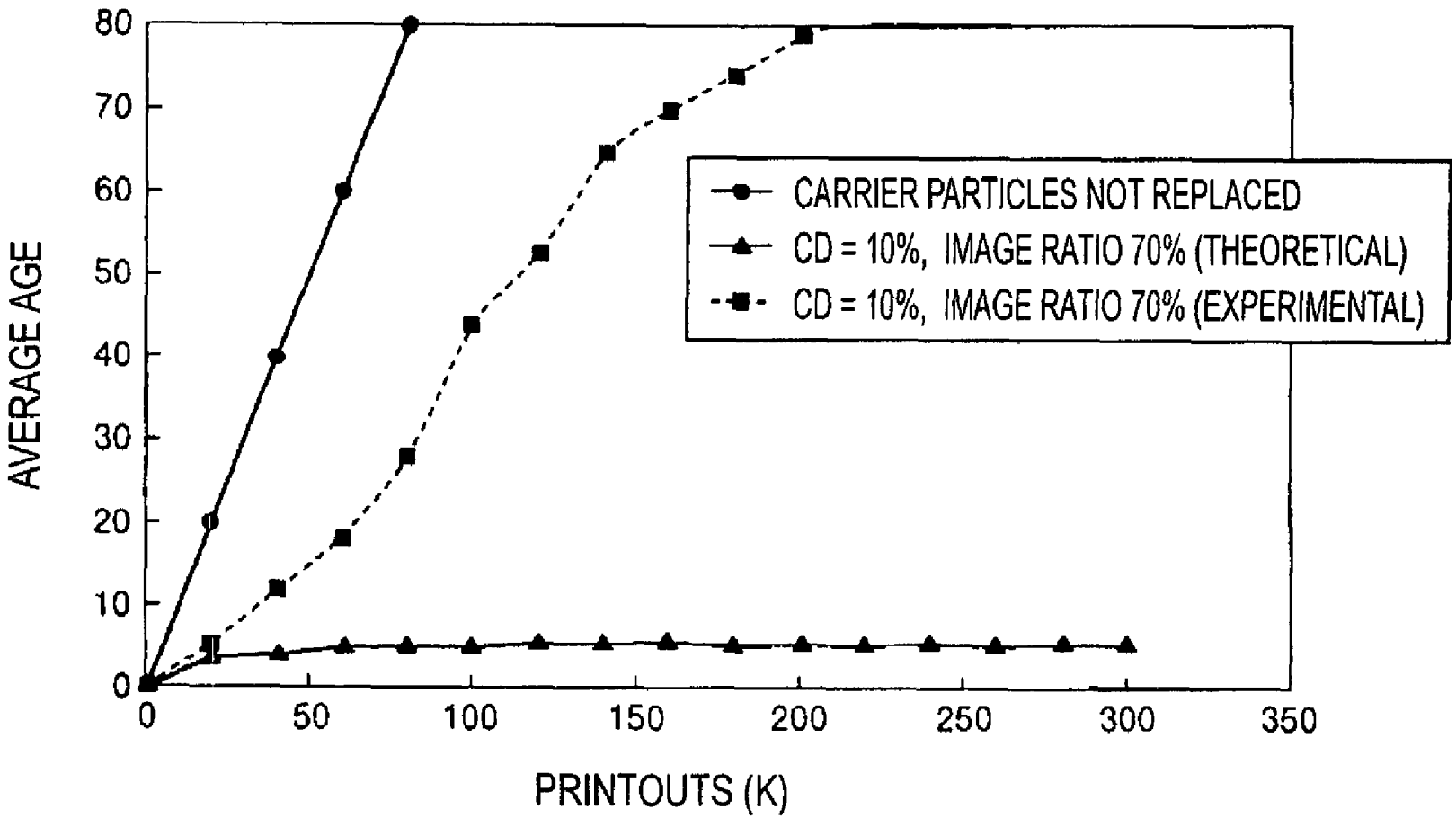
FIG. 5 is a graph illustrating the calculated result and the experimental result of the average age of a carrier for a high image ratio.

First, a conventional example of the relationship between the average age of carrier particles included in a transparent developer and the number of printouts (i.e., the number of images printed out on an A4 size recording sheet) when both the transparent replenishment developer in the transparent replenishment developer tank and color replenishment developer in the color replenishment developer tank have a CD ratio of about 10% and when the image ratio of an image formed with a transparent toner is about 70% is shown in FIG. 5, as described above. As shown in the drawing, the calculated result and the experimental result do not match because replacement of additive particles, which is equivalent to replacement of developer, is not carried out. When images having a high image ratio are printed out repeatedly, accumulation and/or release of the additive particles occur easily, causing a reduction in the amount of the additive particles drained together with the developer. Therefore, the effect of developer degradation due to accumulation of the additive particles surpasses the effect of developer renewal by replacement of the carrier particles. Accordingly, although the effect of carrier particle replacement is effective to a small degree, the developer is degraded as the number of printouts increased.

According to this embodiment, the CD ratio of the replenishment developer in the transparent replenishment developer tank is about 20% and is higher than the CD ratio, which is about 10%, of the replenishment developer in the color toner replenishment developer tank. The actual experimental results under these conditions are shown in FIG. 6.

Figure 6:
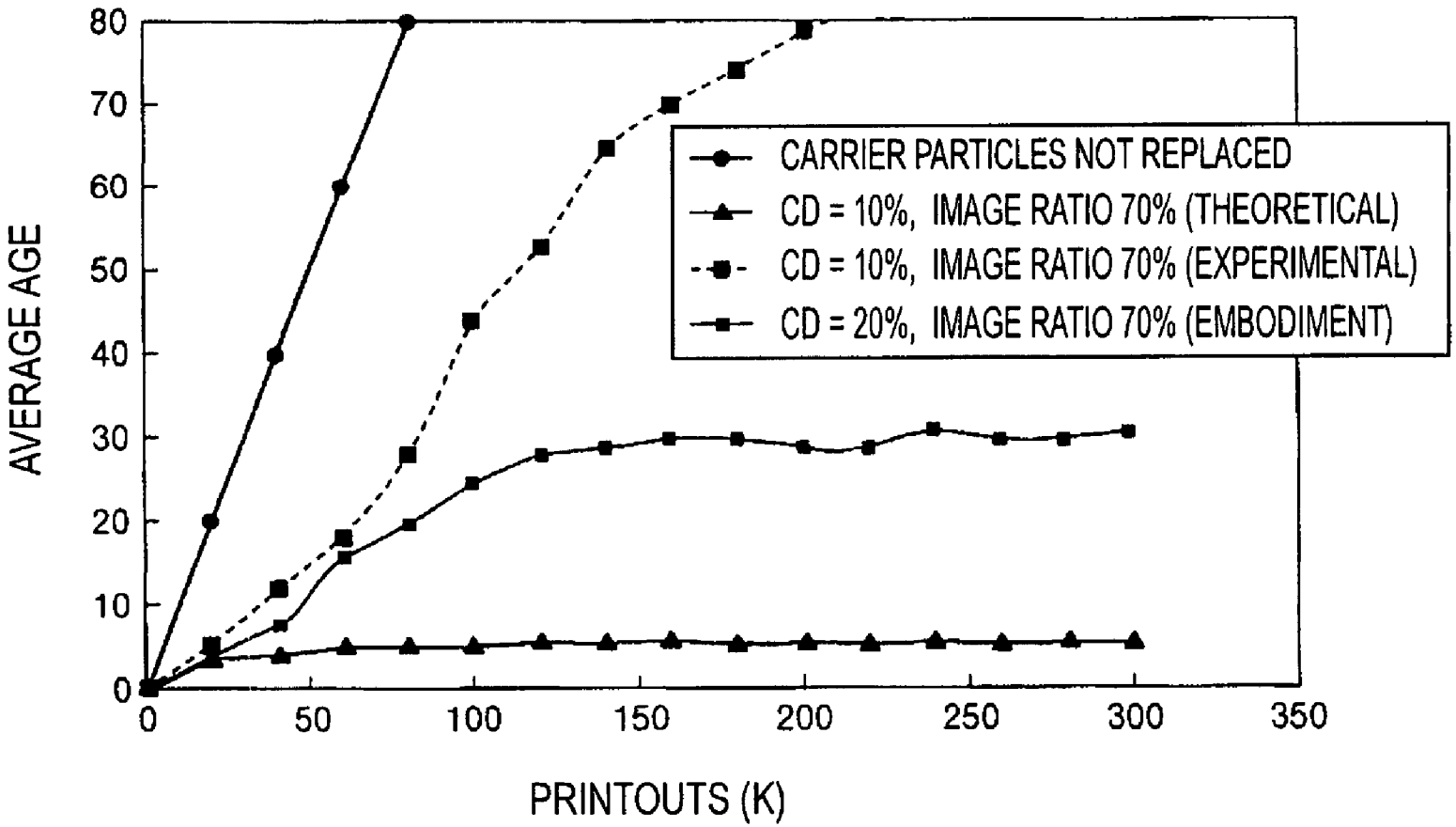
FIG. 6 is a graph illustrating the average age of a carrier according to the present invention.

As shown in FIG. 6, by setting the CD ratio of the replenishment developer in the transparent toner replenishment tank to about 20%, the calculated result and the experimental result do not match completely but, due to the effect carrier particle replacement, the average age of the carrier particles stabilized around 30K printouts, although 300K printouts were made.

When the CD ratios of the replenishment developers in the transparent toner replenishment tank and the color toner replenishment tank were the same (i.e., 10%), the following relationship held:

degradation of additive particles due to accumulation>renewal by replacement of carrier particles.

Since this relationship was changed as below by increasing the CD ratio of the replenishment developer in the transparent toner replenishment tank to a value higher than that of the replenishment developer in the color toner replenishment tank (i.e., changing the CD ratio of only the replenishment developer in the transparent toner to 20%), degradation of the developer was prevented since the following relationship held:

renewal by replacement of carrier particles>degradation of additive particles due to accumulation.

Since the degradation level of the developer was reduced, the replenishment toner was sufficiently charged. As a result, defective fixing caused by excess transparent toner being developed due to scattering and reduction in triboelectrification was prevented.

By increasing the CD ratio of the replenishment developer from 10% to 20%, faster triboelectrification of the developer supplied to the developing unit was possible. As a result, a satisfactory triboelectric state was maintained. Since, in this way, a triboelectric charge was applied relatively quickly to the developer supplied to the developing unit, a sufficient triboelectric state can be applied to the replenishment developer with a simple structure without extending the stirring path of the developer from the inlet (not shown in the drawing) provided at the developer container 41 to the development sleeve 42 and without providing a complicated stirring mechanism for supplying the replenishment developer from the replenishment developer tank 50.

Table 1 shows the change in toner scattering in the apparatus as the number of (i.e., the number of images printed out on an A4 size recording sheet) increases. Toner scattering is mainly caused by a reduction in the triboelectricity applied to the toner. In other words, the level of toner scattering represents the level of carrier particle degradation.

Table 1 (below) shows the level of toner scattering determined by disposing toner-scattering detection sheets at a plurality of positions in the apparatus and measuring the amount of scattered toner attached to these detection sheets at every 100,000th printout. The marks in the table represent the following:

xx: concentration of toner attached to detection sheet is 0.2 or more x: concentration of toner attached to detection sheet is 0.2 or less Δx: concentration of toner attached to detection sheet is 0.15 or more Δ: concentration of toner attached to detection sheet is 0.1 or more ○Δ: concentration of toner attached to detection sheet is 0.05 or more ○Δ: concentration of toner attached to detection sheet is 0.05 or less

TABLE 1

| | Printouts | 100K | 200K | 300K |
|---|---|---|---|---|
| Conventional Example | Transparent developer having CD ratio of 10% | ΔX | X | XX |
| Example According to Embodiment | Transparent developer having CD ratio of 20% | ○ | ○ | ○Δ |

According to the conventional example, after around 100K printouts, an increase in fogging was observed. In the known apparatus used for the experiment, the amount of reflected light from the photosensitive drum 1 or the intermediate transfer belt 5 was read by an optical sensor disposed around the photosensitive drum 1. However, since the amount of reflected light changed due to the increase in fogging, in some cases, the optical sensor misread the amount of reflected light. After around 150K printouts, the optical sensor disposed around the photosensitive drum 1 malfunctioned due to toner scattering. Moreover, defective fixing occurred various times due to excess transparent toner being developed. Therefore, for practical use, it was necessary to replace the developer before 200K printouts.

In contrast, according to this embodiment, malfunction of the optical sensor disposed around the photosensitive drum 1 or defective fixing did not occur up to 300K printouts. When the durability test was completed, only some toner scattering was visible in the vicinity of the development units 4. By increasing the CD ratio of the replenishment developer and increasing the amount of replaced carrier particle, degradation of the developer due to accumulation of additive particles was prevented. The suitable range for the CD ratios of the transparent toner and color toner in the replenishment developers are in the range of 5% to 50%. When the CD ratio is below 5%, the positive effect of replacing the carrier particles is reduced. When the CD ratio is above 50%, the amount of toner that can be used for development is reduced too much and the density followability during development is reduced.

As described above, when the capacity of the developer containers for the color toner and the transparent toner are substantially the same, degradation of the transparent toner due to the additive particles easily occurs when the average image ratio of the image formed with the transparent toner is about 65% or more.

According to this embodiment, the structure of the developing units is simple and downtime due to replenishment of developers is eliminated while defects such as, fogging, toner scattering, and defective fixing, caused by degradation of the developer are prevented.

Second Embodiment

Next, another embodiment of the present invention will be described. The basic structure and operation of the image forming apparatus according to this embodiment are the same as those according to the first embodiment. Therefore, elements that have substantially the same or equivalent functions as those in the image forming apparatus according to the first embodiment are represented by the same reference numerals and their detailed descriptions are not repeated.

According to this embodiment, the CD ratio of the replenishment developer in the transparent toner replenishment tank is about 20%, and the CD ratio of the replenishment developer in the color toner replenishment tank is about 5%, instead of 10% as in the first embodiment.

When the average image ratio of the image formed with the color toner is 30% and the CD ratio of the replenishment developer in the color toner replenishment tank is 5%, the average age of the carrier particle stabilizes around 30K printouts. Furthermore, as described in the first embodiment, when the CD ratio of the replenishment developer in the transparent toner replenishment tank is 20%, the average age of the carrier stabilizes around 30K printouts.

Accordingly, by setting the CD ratio of the replenishment developer in the transparent developer replenishment tank to 20% and setting the CD ratio of the replenishment developer in the color developer replenishment tank to 5%, the average ages of the carrier particles in the color development units 4Y, 4M, 4C, 4K, and 4LK and the transparent development unit 4W become substantially the same.

By making the degradation levels (average ages) of the developers substantially the same, it becomes easier to control the triboelectrification of toners, the amount of toner applied to recording sheets, and the weight ratio of toner particles and carrier particles in the development units as the number of printouts increase. The capacity of the color toner replenishment tank according to this embodiment is increased by 20 g by changing the CD ratio of the replenishment developer from 10% to 5%. As a result, if the average image ratio of the color toner image is 30%, each toner bottle can be used for printing almost 100 more A3-size printouts.

This embodiment has the same advantages as those of the first embodiment. Furthermore, the average age of the carrier particles in the color and transparent toner replenishment tanks is adjusted to the same age so that the above-described advantages are achieved.

According to the present invention, how much greater the weight ratio of the carrier particles in the replenishment developer supplied to the transparent toner developer container should be than the weight ratio of the carrier particles in the replenishment developer supplied to the color toner developer container may be determined according to the degradation level of the developers including color toner and transparent toner as the number of printouts increase and the occurrence of fogging, toner scattering, and defective fixing. When determining the weight ratios, the average age of the carrier particles including the color toner and the transparent toner may be adjusted to the same average age.

In the image forming apparatus according to the fist embodiment, the absolute amount of developer may be reduced by decreasing the capacity of the developer container so that the average age of the carrier particles included the developer container in the color toner developing unit is reduced. By reducing the amount of developer, the developer may be replaced quickly, causing the average age to be reduced.

For example, here, an example case in which there is about an eight times difference in the usage rates of color toner and transparent toner (i.e., an image ratio in which the transparent toner is used about eight times more than the color toner) is considered. In such a case, if the ratios of carrier particles to the developers in the color toner developing units and the transparent toner developing unit are substantially the same and the level of degradation caused by the additive particles for the developer including the transparent toner is about 1.2 time worse than that of the developers including the color toners (wherein the level of degradation caused by the additive particles is determined by the type of additive particles, the amount of additive particles in the developing unit, the amount of additive particles released in the developing unit, and/or the amount of additive particles attached to the carrier), the average age of carrier particles in the transparent toner and the color toners become substantially the same in theory by setting the amount of developer in the transparent toner developing unit to about 500 g and the amount of developer in the color toner developing unit to about 50 g.

According to the present invention, the proportion of carrier particles in the replenishment developer including the transparent toner having a high usage rate is greater than the proportion of carrier in the replenishment developer including the color toner so that the average age of the carrier particles in the transparent and color developing units are matched. This structure, according to the present invention, is effective when the ratio of the developer in the transparent toner developing unit to the developer in the color toner developing unit is less than the value obtained by multiplying the assumed usage rate of the transparent toner compared to the color toner for printing an image having an average image ratio and the degradation level due to the additive particles.

For example, the present invention is effective when, at a predetermined average image ratio, the usage rate of the transparent toner compared to the usage rate of the color toner is about eight times greater and the level of degradation caused by the additive particles for a developer including the transparent toner is about 1.2 time worse than that of the developer including a color toner under predetermined conditions, so long as the difference of the amount of developer in a transparent toner developing unit and the amount of developer in a color toner developing unit is less than ten times.

Embodiments of the present invention have been described above. However, the present invention is not limited to these embodiments.

For example, according to the above-described embodiment, the image forming apparatus employs a configuration including a plurality of developing units and only one photosensitive body and, in particular, includes rotary developing units. However, the present invention is not limited to this configuration. For example, a tandem image forming apparatus that includes horizontally or vertically aligned image forming units (image forming stations) having photosensitive bodies and being capable of transferring toner images formed on the photosensitive bodies onto recording sheets on recording sheet bearing members or intermediate transfer bodies is well-known to one skilled in the art. The present invention may be applied to such tandem image forming apparatus. The present invention may also be applied to an image forming apparatus including a plurality of developing units and only one photosensitive body in which at least one of the developing units are disposed opposite to the photosensitive body and a predetermined developing unit is moved close to or in contact with the photosensitive body at a predetermined timing so as to develop an electrostatic image on the photosensitive body by the predetermined developing unit.

The image forming apparatus may include two productivity preference modes in which one of the two modes is a four-color mode for carrying out image forming in four colors (Y, M, C, and K) and another mode is a six-color or a three-color mode for carrying out image forming in six colors (W, Y, M, C, K, and LK) or three colors (W, K, and LK). In this way, both a reduction in toner consumption and an improvement in productivity may be achieved in response to various needs of the users. Moreover, a five-color mode for carrying out image forming in five colors (W, Y, M, C, and K) may be provided. It is also possible to provide an image forming apparatus having at least one light color toner developing unit for light yellow, magenta, and cyan, for example.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims the benefit of Japanese Application No. 2005-063178 filed Mar. 7, 2005, which is hereby incorporated by reference herein in its entirety.

What is claimed is:

1. A developing device configured to carry out development of an electrostatic image using color toner particles and transparent toner particles, the developing device comprising:

a color developing unit configured to store a color developer which contains the color toner particles, first carrier particles, and first additive particles and configured to carry out development of the electrostatic image;

a transparent developing unit configured to store a transparent developer which contains the transparent toner particles, second carrier particles, and second additive particles and configured to carry out development of the electrostatic image;

a color developer replenishment container configured to store a color replenishment developer including at least the color toner particles and the first carrier particles and configured to replenish the color replenishment developer in the color developing unit;

a transparent developer replenishment container configured to store a transparent replenishment developer including at least the transparent toner particles and the second carrier particles and configured to replenish the transparent replenishment developer in the transparent developing unit;

a color developer discharge opening provided at the color developing unit and configured to discharge the color developer in the color developing unit outside the color developing unit as the color developer replenishment container replenishes the color developing unit with the color replenishment developer; and a transparent developer discharge opening provided at the transparent developing unit and configured to discharge the transparent developer in the transparent developing unit outside the transparent developing unit as the transparent developer replenishment container replenishes the transparent developing unit with the transparent replenishment developer, wherein a carrier particle weight ratio of the transparent replenishment developer is higher than a carrier particle weight ratio of the color replenishment developer.

2. The developing device according to claim 1, wherein before carrying out replenishment by the transparent and color developer replenishment containers, the weight of the transparent toner particles stored in the transparent developer replenishment container is lower than the weight of the color toner particles stored in the color developer replenishment container.

3. The developing device according to claim 1, wherein an average image ratio of the electrostatic image developed by the transparent toner particles is 65% or more.

4. The developing device according to claim 2, wherein an average image ratio of the electrostatic image developed by the transparent toner particles is 65% or more.

5. A method of forming an image by carrying out development of an electrostatic image using color toner particles and transparent toner particles, the method comprising the steps of:

developing the electrostatic image by a color developing unit with a color developer which contains the color toner particles, first carrier particles, and additive particles;

developing the electrostatic image by a transparent developing unit with a transparent developer which contains the transparent toner particles, second carrier particles, and additive particles;

replenishing the color developing unit with a color replenishment developer including at least the color toner particles and the first carrier particles, the color replenishment developer being supplied from a color developer replenishment container;

replenishing the transparent developing unit with a transparent replenishment developer including at least the transparent toner particles and the second carrier particles, the transparent replenishment developer being supplied from a transparent developer replenishment container;

discharging the color developer in the color developing unit outside the color developing unit via a color developer discharging opening provided at the color developing unit responsive to replenishing the color developing unit with the color replenishment developer; and discharging the transparent developer in the transparent developing unit outside transparent developing unit via a transparent developer discharging opening provided at the transparent developing unit responsive to replenishing the transparent developing unit with the transparent replenishment developer, wherein a carrier particle weight ratio of the transparent replenishment developer is higher than a carrier particle weight ratio of the color replenishment developer.

6. The method according to claim 5, wherein before the steps of replenishing the color and transparent developing units, the weight of the transparent toner particles stored in the transparent developer replenishment container is lower than the weight of the color toner particles stored in the color developer replenishment container.

7. The method according to claim 5, wherein an average image ratio of the electrostatic image developed by the transparent toner particles is 65% or more.

8. The method according to claim 6, wherein an average image ratio of the electrostatic image developed by the transparent toner particles is 65% or more.

* * * * *